United States Patent [19]

Levenez et al.

[11] Patent Number: 4,608,910

[45] Date of Patent: Sep. 2, 1986

[54] COMPRESSED FLUID SAVING DEVICE

[75] Inventors: Yves Levenez, Vaux-le-Penil; André Legris, Rennes, both of France

[73] Assignee: Legris, Rennes, France

[21] Appl. No.: 743,887

[22] Filed: Jun. 12, 1985

Related U.S. Application Data

[63] Continuation of Ser. No. 475,483, Mar. 15, 1983, abandoned.

[30] Foreign Application Priority Data

Mar. 19, 1982 [FR] France ..... 82 05042
Mar. 3, 1983 [FR] France ..... 83 03513

[51] Int. Cl.[4] ..... F15B 15/22

[52] U.S. Cl. ..... 91/409; 91/410; 91/420; 91/421

[58] Field of Search ..... 91/410, 420, 433, 421, 91/408, 409

[56] References Cited

U.S. PATENT DOCUMENTS

| | | | |
|---|---|---|---|
| 1,003,163 | 9/1911 | Turner | 91/433 |
| 2,372,942 | 4/1945 | Fischer et al. | 91/433 |
| 2,467,508 | 4/1949 | Trautman | 91/420 |
| 3,566,747 | 3/1971 | Frame | 91/35 |
| 3,643,684 | 2/1972 | Moore | 137/493.7 |
| 3,768,371 | 10/1973 | Prime | 92/86 |

FOREIGN PATENT DOCUMENTS

| | | | |
|---|---|---|---|
| 1145771 | 2/1960 | Fed. Rep. of Germany | 91/410 |

OTHER PUBLICATIONS

Neues aus der Technik, Nos. 5 and 6, Dec. 1964.

*Primary Examiner*—Robert E. Garrett
*Assistant Examiner*—Mark A. Williamson
*Attorney, Agent, or Firm*—Fitzpatrick, Cella, Harper & Scinto

[57] ABSTRACT

The invention relates to a compressed fluid saving device positioned between the outlet of a distributor and the admission of a pneumatic jack. The device comprises a valve which is kept open, to allow the flow of driving fluid into one chamber of the jack from the start and right through the stroke, by the exhaust back-pressure escaping from the other chamber of the jack, and acting on the piston of said valve. When the back-pressure disappears, the valve closes under the action of a screw-adjustable spring.

27 Claims, 23 Drawing Figures

Fig. 18
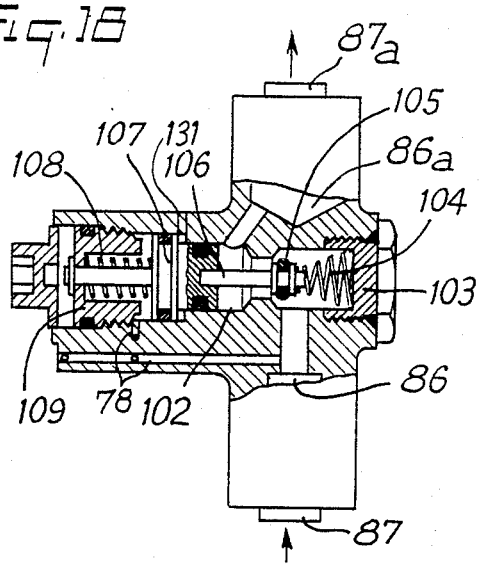
Fig. 19
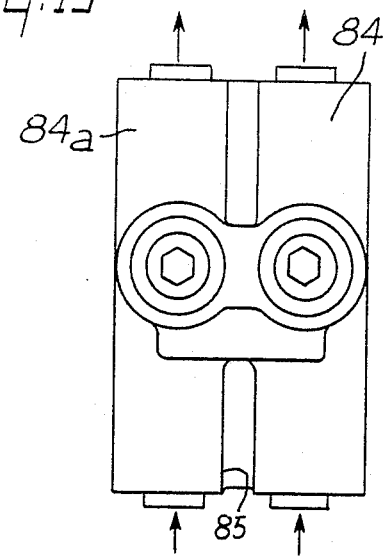
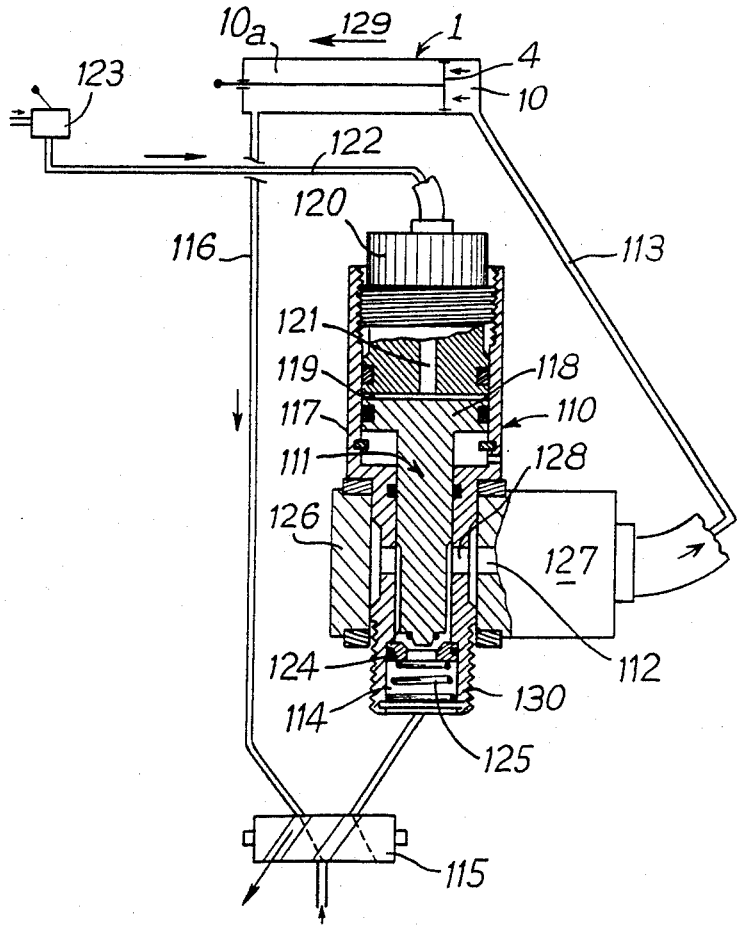
Fig. 20

COMPRESSED FLUID SAVING DEVICE

This application is a continuation of application Ser. No. 475,483 filed Mar. 15, 1983, now abandoned.

The present invention relates to a compressed fluid saving device.

Jacks are generally known to be oversized with respect to the load that they are required to move, this in order to meet the critera of displacement speed and mechanical strength, and as a result, the quantity of compressed fluid consumed is greater than should be necessary to move the said load.

When the piston of the jack starts moving, all the pressure of the fluid in the supply circuit is exerted on said piston, causing a rapid start, after which the expansion of the fluid causes a drop of pressure in the driving chamber of the cylinder, said pressure-drop being all the greater if the load to be lifted is small. However, at the end of the piston stroke, the pressure of the driving fluid rises up again unnecessarily to reach the value of the fluid supply circuit.

In FIG. 1*a* is shown the curve A of pressure P as a function of time T representing the duration of the piston stroke; the level of pressure in the circuit being indicated in B and the end of the piston stroke in C.

In FIG. 1*b* is shown a curve D of pressure as a function of time, for the same cylinder equipped with means to regulate the exhaust flow and a curve E for the same cylinder equipped with means for limiting the supply flow.

It has been found that the fluid consumption is the same whether or not the cylinder is equipped with a flow regulating device reducing the speed of the piston.

It is the object of the present invention to overcome this disadvantage and to reduce the consumption of compressed fluid in a pressure-using apparatus such as a jack, by proposing a device comprising means to allow the flow of driving fluid under pressure through most of the stroke of the movable member of the jack and to stop the flow of pressurized fluid before the end or at the end of the piston stroke.

In FIG. 1*c*, is shown the curve F of pressure related to the piston stroke duration for the same jack as in FIGS. 1*a* and 1*b*, said curve F corresponding to a jack equipped with a fluid saving device according to the invention, in which the flow of compressed fluid directed into the driving chamber of said jack is cut off either before the end, or just at the end of stroke C of the piston. This disposition makes it possible, as illustrated in FIG. 1*c*, to reduce the volume of unnecessarily used compressed fluid resulting from the difference between pressure B of the compressed fluid supply circuit and the adequate driving pressure needed to bring the piston to the end of its stroke in the necessary condition of speed and mechanical strength.

In FIG. 1*d* is shown a pressure/time curve G for the same jack equipped with a saving device according to the invention and comprising means to limit the speed of the piston. The saving with this disposition is all the greater since the speed is slower.

The saving device according to the invention is preferably fitted between the jack orifice and the outlet of the supply circuit, as close as possible to the latter.

According to one characteristic of the invention, said device comprises non-return means capable of allowing through a full flow of the jack exhaust fluid during the return stroke of the piston.

According to another characteristic of the invention, the valve is closed under the pressure of the driving fluid.

The invention will be more readily understood on reading the following description, with reference to the accompanying drawings in which:

FIGS. 1*a* to 1*d* are diagrams showing the curves of pressure related to the duration of a piston stroke in a jack;

FIG. 18 is an axial section of another embodiment of the saving device mounted in a dual-connector;

FIG. 19 is a plan view of the device shown in FIG. 18;

FIG. 20 is a longitudinal section of a saving device mounted in a single connector.

Figure 1A:
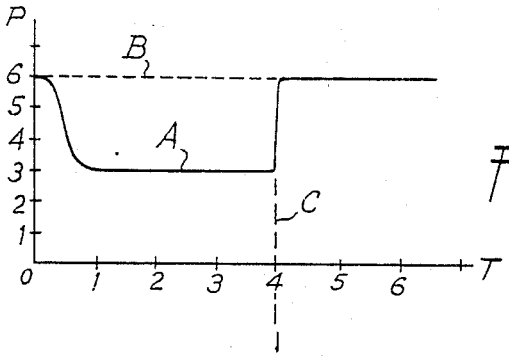
Figure 1B:
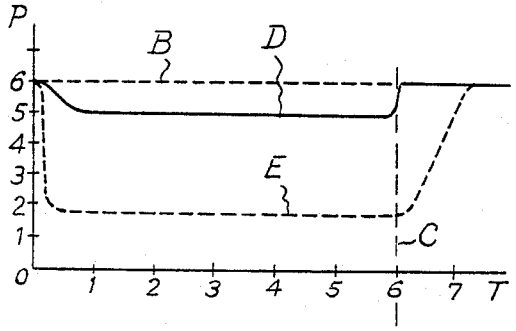
Figure 1C:
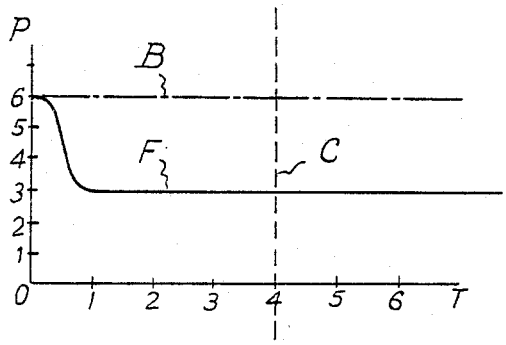
Figure 1D:
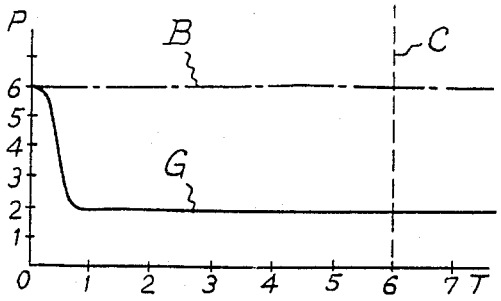
Figure 2:
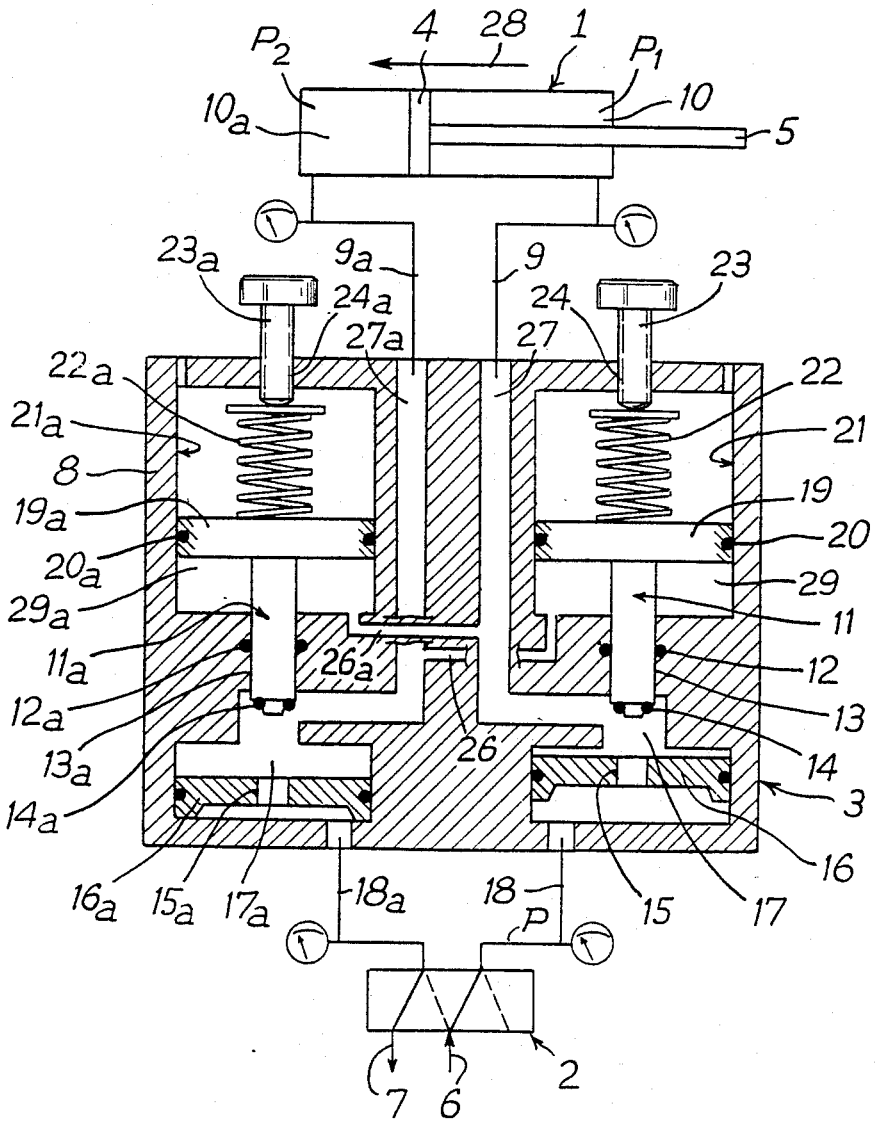
FIG. 2 is a cross-sectional view of a compressed fluid saving device, working by pressure-drop, according to the invention, shown in the middle of a jack cycle.
Figure 3:
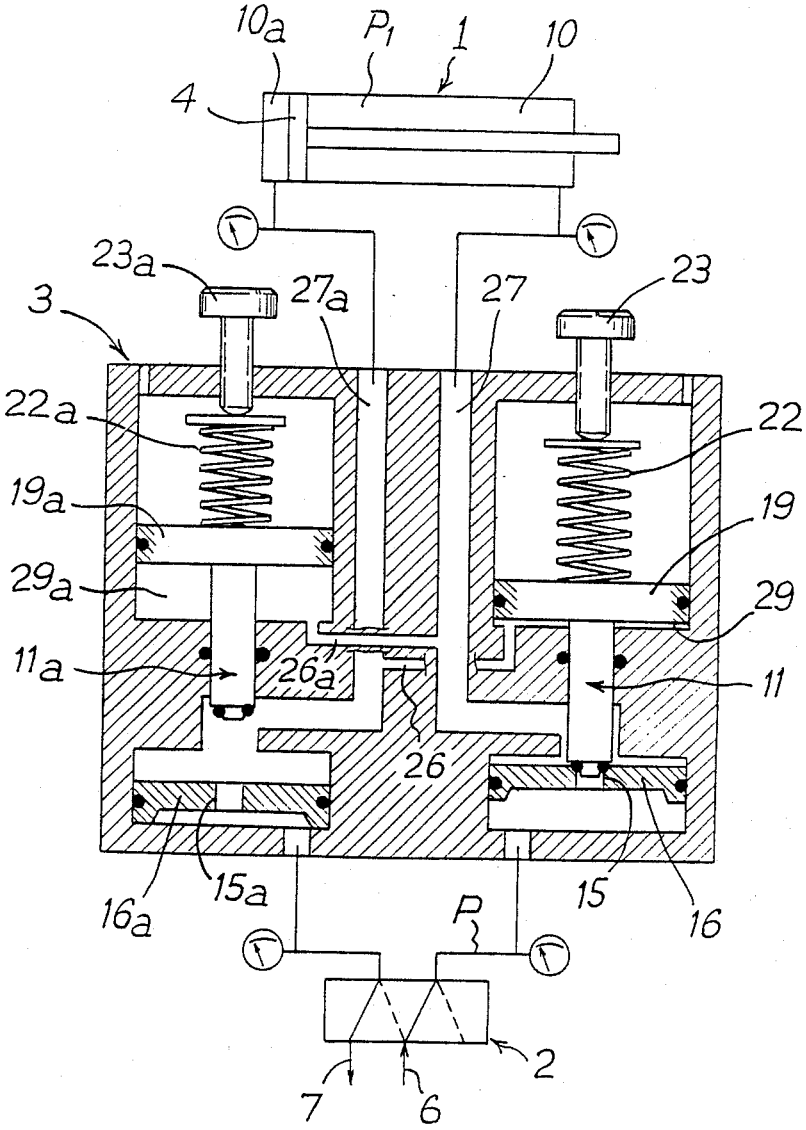
FIG. 3 is a similar view of the same device at the end of a jack cycle.

FIGS. 2 and 3 illustrate a jack 1 which is connected to a pneumatic distributor 2 via a compressed fluid saving device 3 according to the invention, said double-acting jack 1 comprising a cylinder inside which moves a piston 4 connected via a rod 5 to a load to be moved. The distributor 2 is furthermore adapted to cause said jack to communicate with a compressed fluid supply circuit 6 and with an exhaust orifice 7 issuing into the atmosphere.

The fluid saving device 3 comprises a body 8 in which are mounted two saving assemblies which are respectively connected, via pipes 9, 9*a*, with chambers 10, 10*a* of the jack 1, each assembly comprising a valve 11, 11*a* mounted for sliding, with interposition of a seal 12, 12*a*, inside a bore 13, 13*a* provided in the body 8, said valve being provided at one of its ends, forming closing member, with a seal 14, 14*a* capable of closing off an orifice 15, 15*a* of a seat 16, 16*a* mounted for sliding inside a recess 17, 17*a* communicating via a conduit 18, 18*a* with the distributor 2.

At their end opposite said closing off member, the valves 11, 11*a* comprise a piston 19, 19*a* equipped with a seal 20, 20*a* and moving inside a cylinder 21, 21*a* provided in the body 8, said piston being subjected on its upper face to the action of a spring 22, 22*a*, one end of which rests against the end of a screw 23, 23*a* engaged in a tapped hole 24, 24*a* provided in the body 8 at the upper part of cylinders 21, 21*a*. Said spring 22, 22*a* tends to push back the valve 11, 11*a* against the seat 16, 16*a*.

The space 29, 29*a* provided between the bottom of the cylinder 21, 21*a* and the face of piston 19, 19*a* which is opposite the resting face of the spring, communicates via a conduit 26, 26*a* with a pipe 27, 27*a* connecting the jack to recesses 17, 17*a* above the seat 16, 16*a*.

The jack moving in the direction of arrow 28, the driving chamber 10 is supplied with driving fluid $P_1$ under pressure via pipes 9 and 27, orifice 15 of seat 16 (valve 11 being open) conduit 18 and distributor 2 which is connected with the circuit 6 supplying compressed air at a pressure P.

Moreover, the chamber 10*a* of jack 1 being in a fluid exhaust position, there occurs in said chamber a back-pressure P2, so that the fluid flows through pipes 9*a*, 27*a*, orifice 15*a* (valve 11*a* being open) pipe 18*a* and distributor 2 which is connected with the outside in 7.

Pipe 27*a* being connected via pipe 26 to chamber 29 situated under piston 19, the back-pressure P2 exerts on said piston a force which opposes the spring 22 which is compressed, thereby causing the opening of the valve 11 to allow the driving fluid P1 to flow towards chamber 10 of the jack.

Also, pipe 27 being connected, via pipe 26*a*, to chamber 29*a* situated under piston 19*a*, the driving pressure P1 exerts on said piston a force which opposes the spring 22*a*, thus compressing it, and causing the opening of valve 11*a* to allow the flow of exhaust fluid at back-pressure P2 towards distributor 2 and out into the atmosphere through 7.

When piston 4 of the jack reaches the end of a stroke, such as illustrated in FIG. 3, the back-pressure P2 in the exhaust chamber 10 becomes nil and as a result the fluid escapes from space 29 under piston 19 so that the valve 11 under the action of the spring 22 is pushed back in the closed position against the orifice 15 of seat 16 which is lifted by the driving pressure P.

Consequently, the supply of driving fluid of pressure P1 to chamber 10 of the jack is stopped; but the fluid left in chamber 10, pipes 27, 26*a* and space 29*a* under piston 19*a* keeps the valve 11*a* open thus allowing all the fluid to flow out towards the exhaust.

When the distributor is reversed, the position of valves 11, 11*a* is reversed with respect to FIG. 2, so as to cause the piston to move in the reverse direction to arrow 28.

In order to regulate the flow and because of the speed of piston 4 of jack 1, the hardness of the springs 22, 22*a* is adjusted by compressing these springs by way of screws 23, 23*a*. From a certain compression of said springs, the device works in expansion.

In this case, the exhaust back-pressure which reduces during the stroke is overcome by the spring before the end of the stroke. The stroke continues due only to the expansion of the fluid already admitted in the driving chamber.

Figure 4:
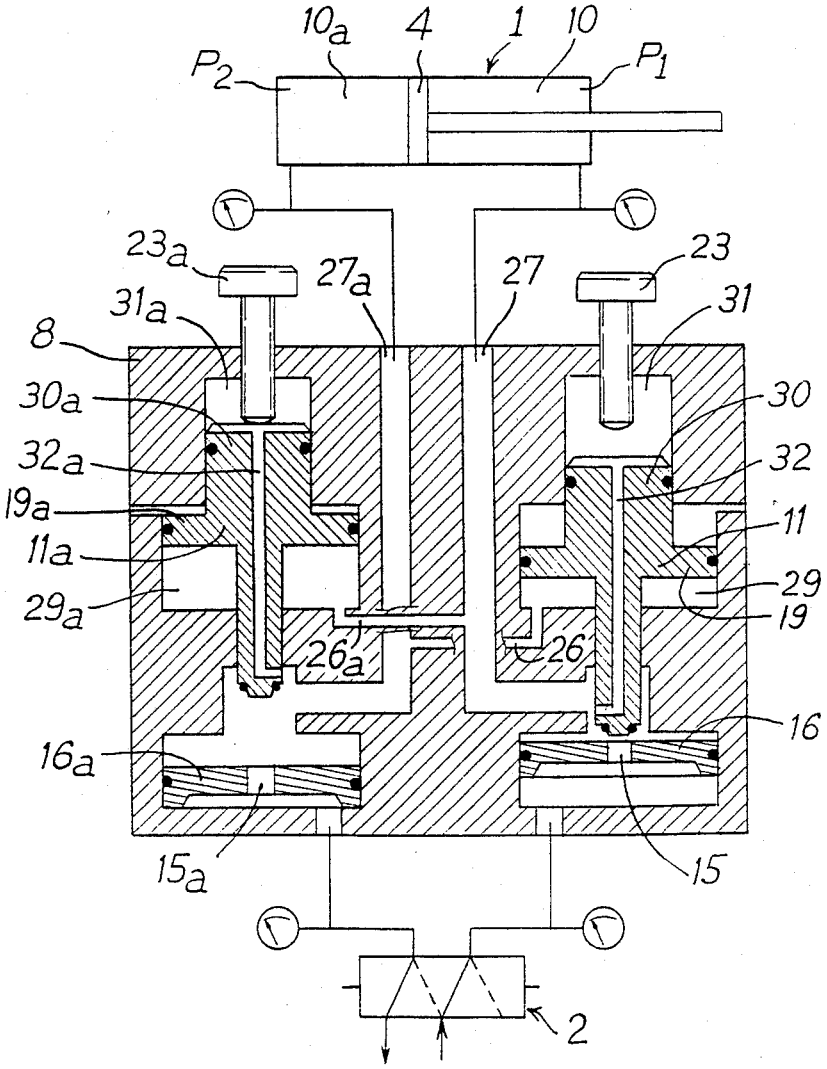
FIG. 4, is a cross-sectional view of another embodiment of the saving device in the middle of a jack cycle.
Figure 5:
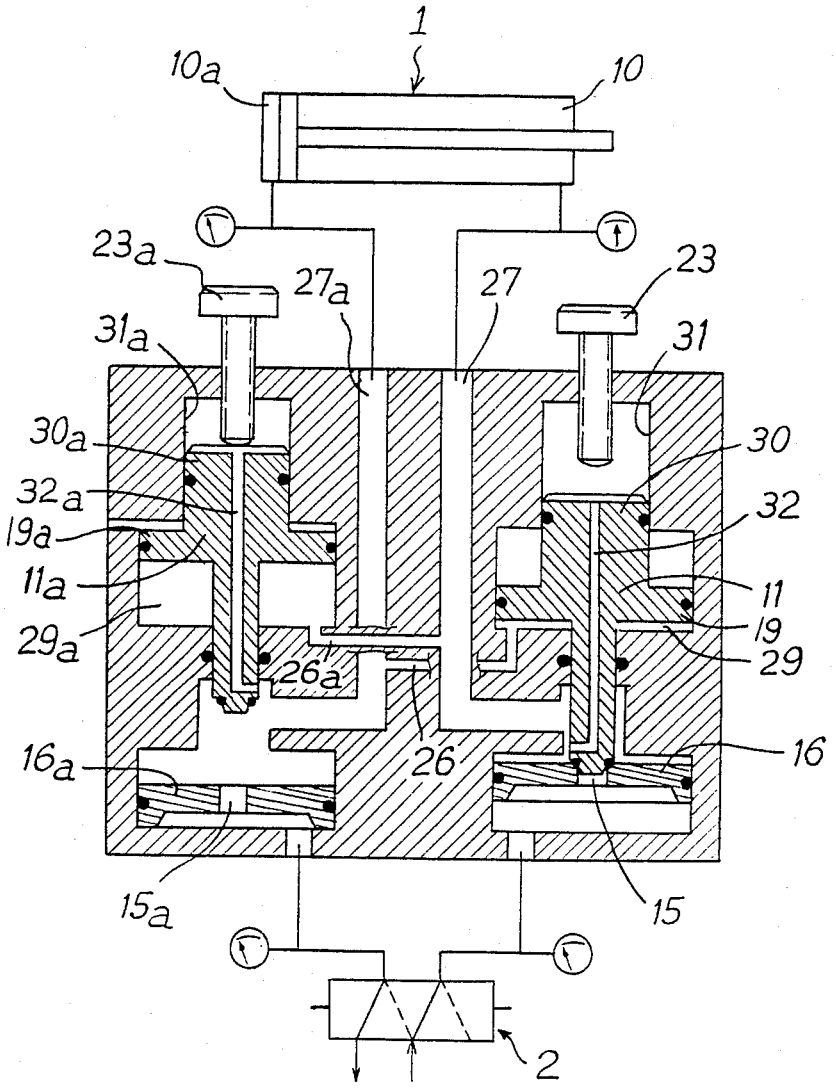
FIG. 5 is a view of the same device as shown in FIG. 4 at end of cycle.

FIGS. 4 and 5 illustrate a variant embodiment of the saving device in which the force required to close the valve when the exhaust back-pressure has disappeared is no longer supplied by the spring 22, 22*a* but instead, by the pressure of the driving fluid P1.

To this effect, the piston 19, 19*a* is extended by a part 30, 30*a* of smaller cross-section than the piston 19, 19*a* and moving inside a cylindrical housing 31, 31*a*.

Moreover, the valve 11, 11*a* has an axial channel 32, 32*a* which issues at its upper part into space 31, 31*a* and at its lower part into pipe 27.

Owing to this disposition, it is possible to bring the driving fluid P1 into space 31 (FIG. 4), where its pressure on the parts 30 of piston 19 works against the fluid under pressure which is in the chamber 29 under piston 19; but, the cross-section of part 30 being smaller than that of piston 19 which is subjected to the pressure of the exhaust fluid P2, the valve 11 is kept open against the screw 23 permitting to reduce the flow rate on demand and, by way of consequence, reducing the speed of the jack; the quantity of fluid consumed reducing with the speed.

When pressure P2 disappears in chamber 29, the fluid under pressure in chamber 31 pushes the piston of valve 11 downwards in a closing off position (FIG. 5).

Figure 6:
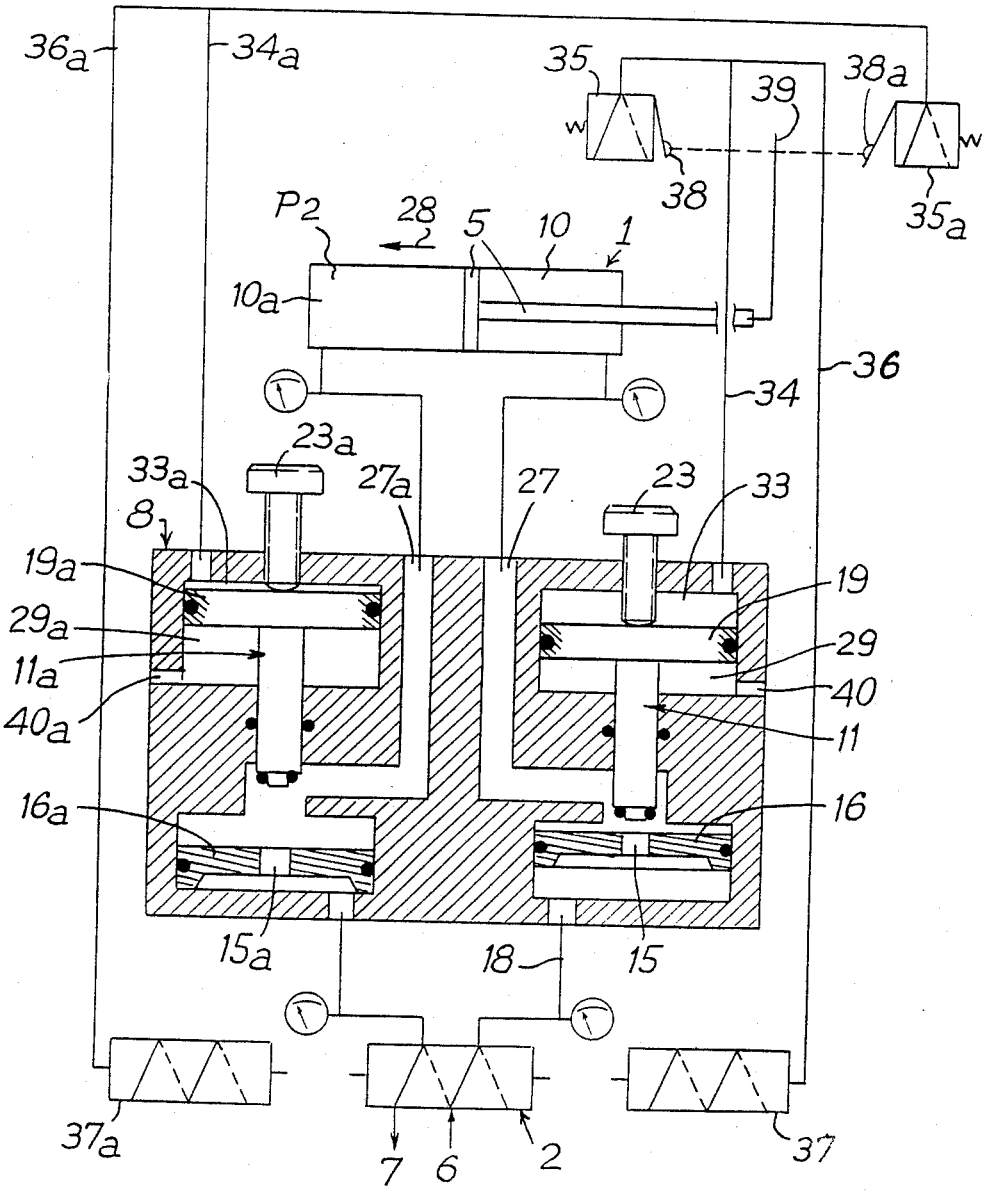
FIG. 6 is a cross-sectional view of a compressed fluid saving device controlled by a pneumatic signal and shown in the middle of a jack cycle.
Figure 7:
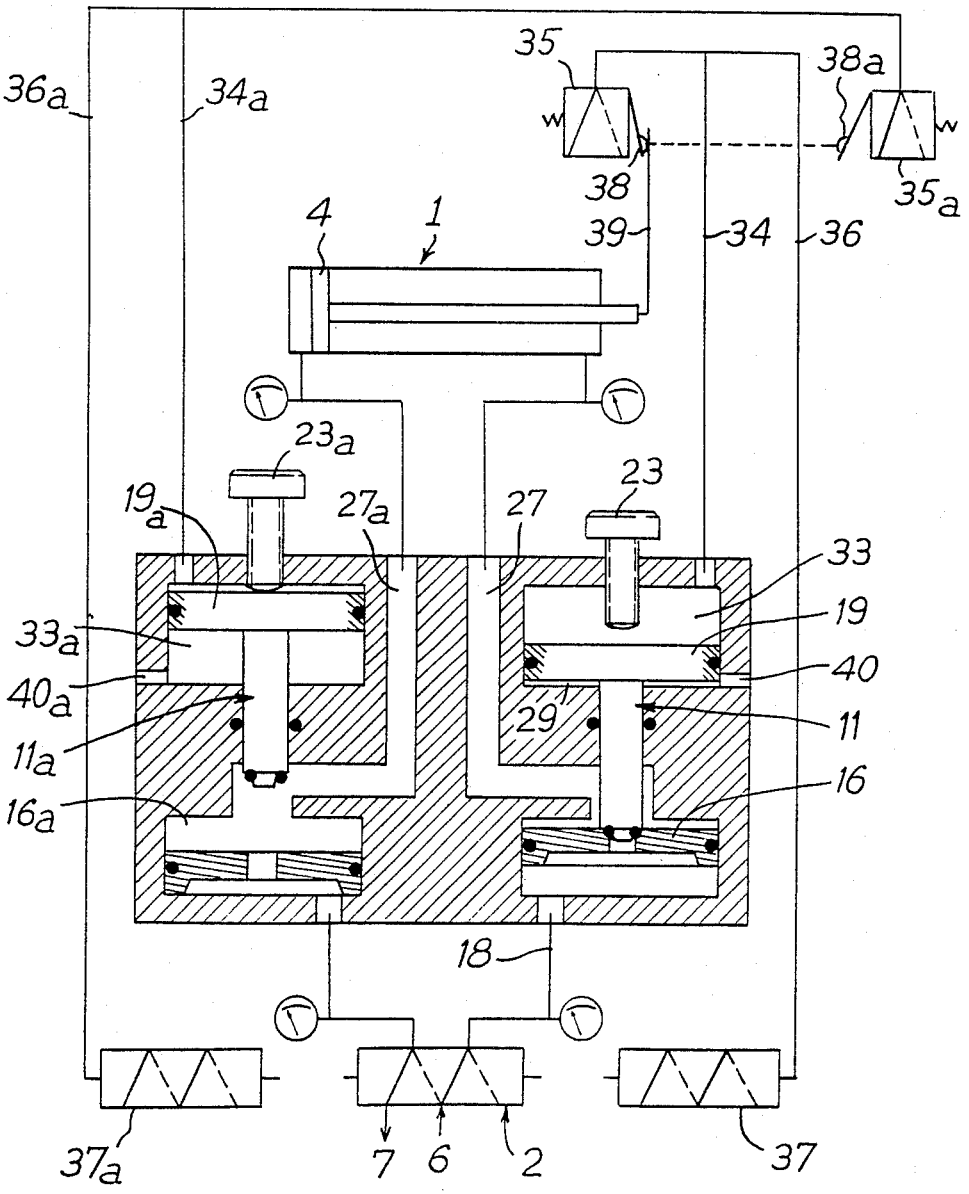
FIG. 7 is a cross-sectional view of the same device as shown in FIG. 6 at the end of a jack cycle.

FIGS. 6 and 7 illustrate another embodiment of the saving device in which piston 19 is controlled by a pneumatic signal corresponding to a position of the piston 4 of the jack 1 before the end or at the end of a stroke.

To this effect, a chamber 33, 33*a* situated above piston 19, 19*a* is connected via a conduit 34, 34*a* to a cell 35, 35*a* or end-of-stroke sensor, supplied from a conduit 36, 36*a* and from a distributor 37, 37*a* selectively connecting the cell to a source of pressurized fluid and to the atmosphere.

Said cells 35, 35*a* are equipped with probe means 38, 38*a* adapted to contact with a part 39 of the rod 5 of piston 4, so that when the cell 35, 35*a* is actuated, it can send a pneumatic signal to the chamber 33, 33*a* which pushes piston 19, 19*a* downwards, thus causing the closure of the valve 11, 11*a*.

When the piston 4 of the jack 1 moves in the direction of arrow 28 (FIG. 6), the driving pressure P arriving in 18 through the distributor 2, pushes the seat into a closure position, and chamber 33, being then non-pressurized, lifts the valve 11 to an open position, thus supplying the chamber 10 of the jack via pipe 27.

In addition, chamber 33*a* being also non-pressurized and the valve being in the open position, the fluid under pressure P2 escapes from chamber 10*a* of the jack via pipe 27*a* and distributor 2.

When piston 4 reaches the end of the stroke (FIG. 7) and when part 39 of piston rod 5 contacts with the probe means 38 of the cell 35, said cell, supplied by distributor 37, then sends a pneumatic signal or a certain quantity of fluid into chamber 33 which pushes piston 19 downwards as well as the valve 11 which comes into a closure position on the seat 16. Chamber 29 being connected with the atmosphere via orifice 40, the piston 19 can move without encountering any form of resistance.

Moreover, when piston 4 reaches the end of the stroke, chamber 10*a* and pipe 27*a* empty out immediately, so that the back-pressure P2 disappears.

When the distributor 2 is reversed, although the valve 11 is still pushed in a closing off position by the cell 35, the disappearance of the pressure in the circuit at admission 18 permits the exhaust due to the seat 16 being pushed back and being brought into an open position.

As in the embodiment illustrated in FIGS. 4 and 5, the screws 23, 23*a* enable control of the flow of fluid and as a result the speed of the piston 4 of the jack.

The cell 35, 35*a* or end-of-stroke sensor can be replaced by a sensor of the passage of the movable member or piston 4 of the jack.

It is also possible to use a pressure-drop sensor delivering a pneumatic signal when the pressure of the jack drops on the exhaust side.

According to yet another embodiment of the invention, a pneumatic signal is used which is issued from a circuit associated to the movement of another jack which initiates said signal immediately after the end of the stroke of the control jack piston.

Figure 8:
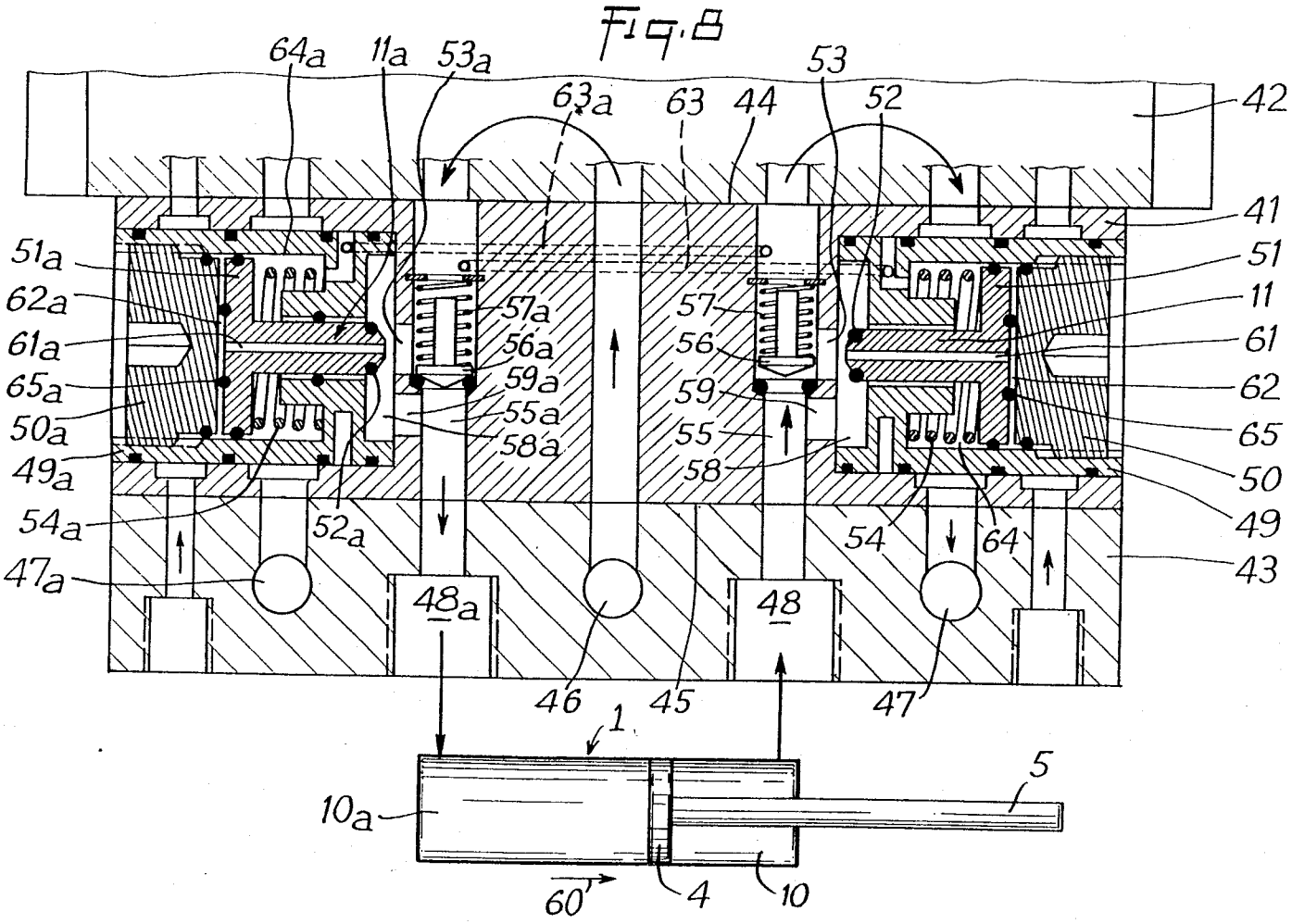
FIG. 8 is an axial section of a saving device controlled by pressure-drop, and mounted between a distributor and a base member.

FIG. 8 illustrates a compressed fluid saving device according to the invention which comprises a body 41 mounted between a distributor 42 and a base 43 with both of which said body is in contact by two of its faces 44 and 45, the said base 43 presenting integrated channels, one channel 46 connected to the compressed fluid distributor, channels 47, 47*a* connected to the atmosphere and channels 48, 48*a* connected to chamber 10, 10*a* of the jack 1. Fluid channels 45, 47, 47*a*, 48, 48*a* issue on to one of the faces 46 of the body 41 which is provided on its other face 44 with orifices issuing into the pipes of the distributor 42.

At each end of the body 41, there is provided a bore in which is mounted a sleeve 49, 49*a* presenting a cylinder closed off by a plug 50, 50*a* and in which is slidably mounted a piston 51, 51*a* of a valve 11, 11*a* equipped with a closing member or seal 52, 52*a* adapted to close off an orifice 53, 53*a*.

The piston 51 is subjected on one of its faces to the action of a spring 54, 54*a* which holds the valves 11, 11*a* in an open position in the absence of fluid under pressure.

Moreover, the body 41 comprises a pipe 55, 55*a* in which is mounted a non-return valve 56, 56*a* subjected to the action of a spring 57, 57*a* ensuring only the passageway between chamber 10, 10*a* and the exhaust 47, 47*a*. Said conduit 55, 55*a* communicates with a chamber 58, 58*a* on one side of valve 56, 56*a* via orifice 53, 53*a* and on the other side of the valve, via orifice 59, 59*a*.

The valve 11, 11*a* is provided with an axial conduit 61, 61*a* through which chamber 58, 58*a* can communicate with chamber 62, 62*a* and a conduit 63, 63*a* connecting conduit 55, 55*a* to a chamber 64, 64*a* situated under the piston 51, 51*a*.

When piston 4 of the jack 1 moves in the direction of arrow 60, the driving fluid coming from channel 46 and directed by the distributor 42 into the conduit 55*a*, flows through orifice 53*a* and 59*a* and through chamber 58*a*, the valve 11*a* being opened under the conjugated action of the spring 54*a* and of the exhaust fluid flowing from pipe 55 and from pipe 63*a* which reaches chamber 64*a*, the conjugated force of the spring 54*a* and of the pressure of the exhaust fluid being greater than the force exerted by the pressure of the driving fluid into chamber 62*a* defined by the seal 65*a*.

On the contrary, when the piston 4 of the jack reaches end-of-stroke, the pressure of the exhaust fluid flowing from chamber 10 disappears into chamber 64*a* and the pressure exerted in chamber 62*a* being stronger than the action of the spring 54*a*, the valve 11*a* closes, cutting off the way through the orifice 53*a* and the action of the driving fluid in chamber 10*a* of the jack 1.

Moreover, during the stroke of the piston 4, the fluid escapes from chamber 10 towards channel 47 by opening valve member 56 and going through the distributor 42.

Figure 9:
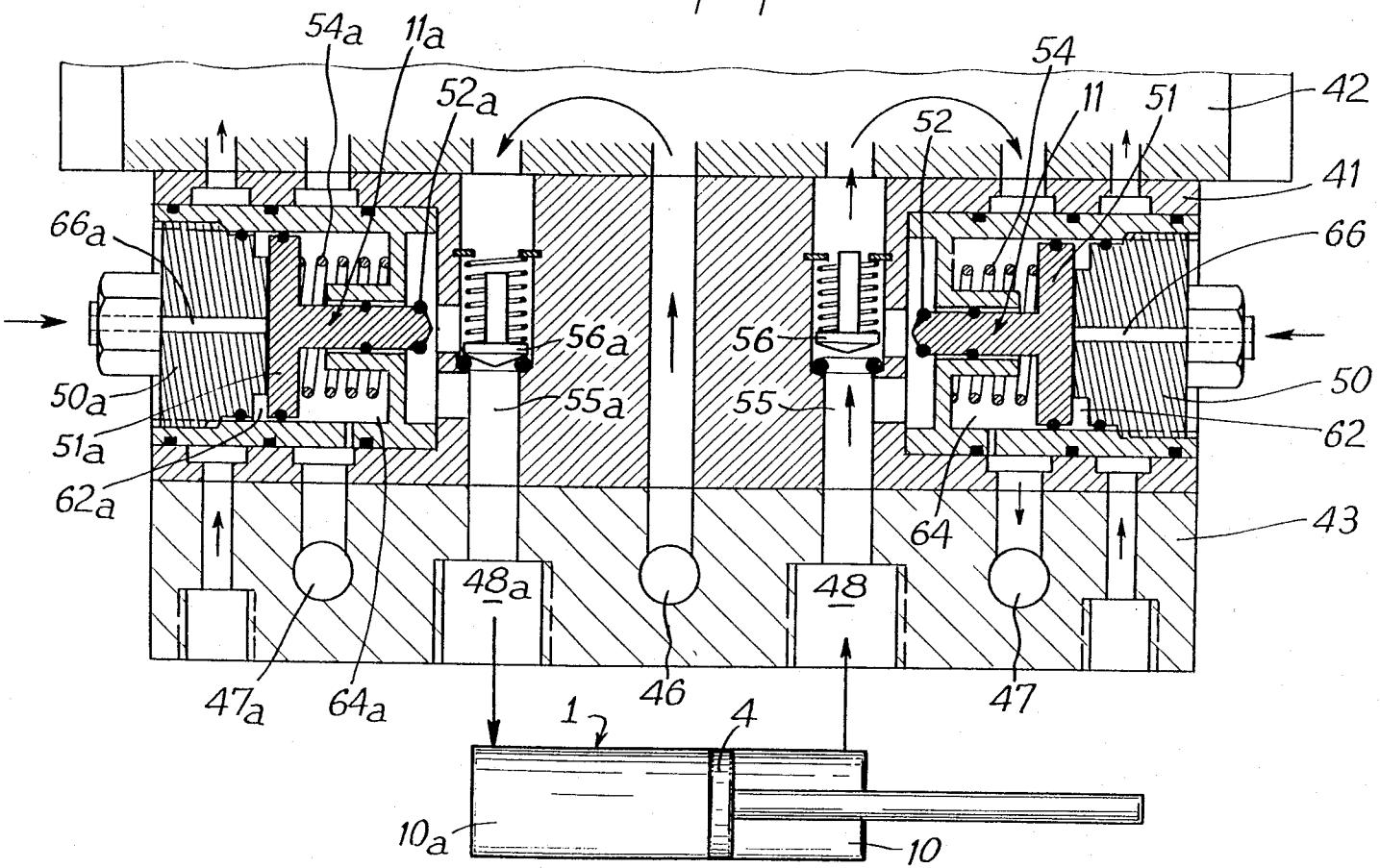
FIG. 9 is an axial section of a saving device controlled by a pneumatic signal, mounted in the same way.

FIG. 9 illustrates a variant of the saving device wherein the body 41 is mounted as illustrated in FIG. 8, between the distributor 42 and the base 43.

However, piston 51, 51*a* is not connected to chamber 58, 58*a* and the plugs 50, 50*a* is provided with a conduit 66, 66*a* which is linked for example with a sensor of the position of the piston 4 before the end or at the end of the stroke, which sensor sends into chamber 62, 62*a* a pneumatic signal or a certain quantity of fluid pushing the piston 51 and the valve 11, 11*a* to a closing off position.

Figure 10:
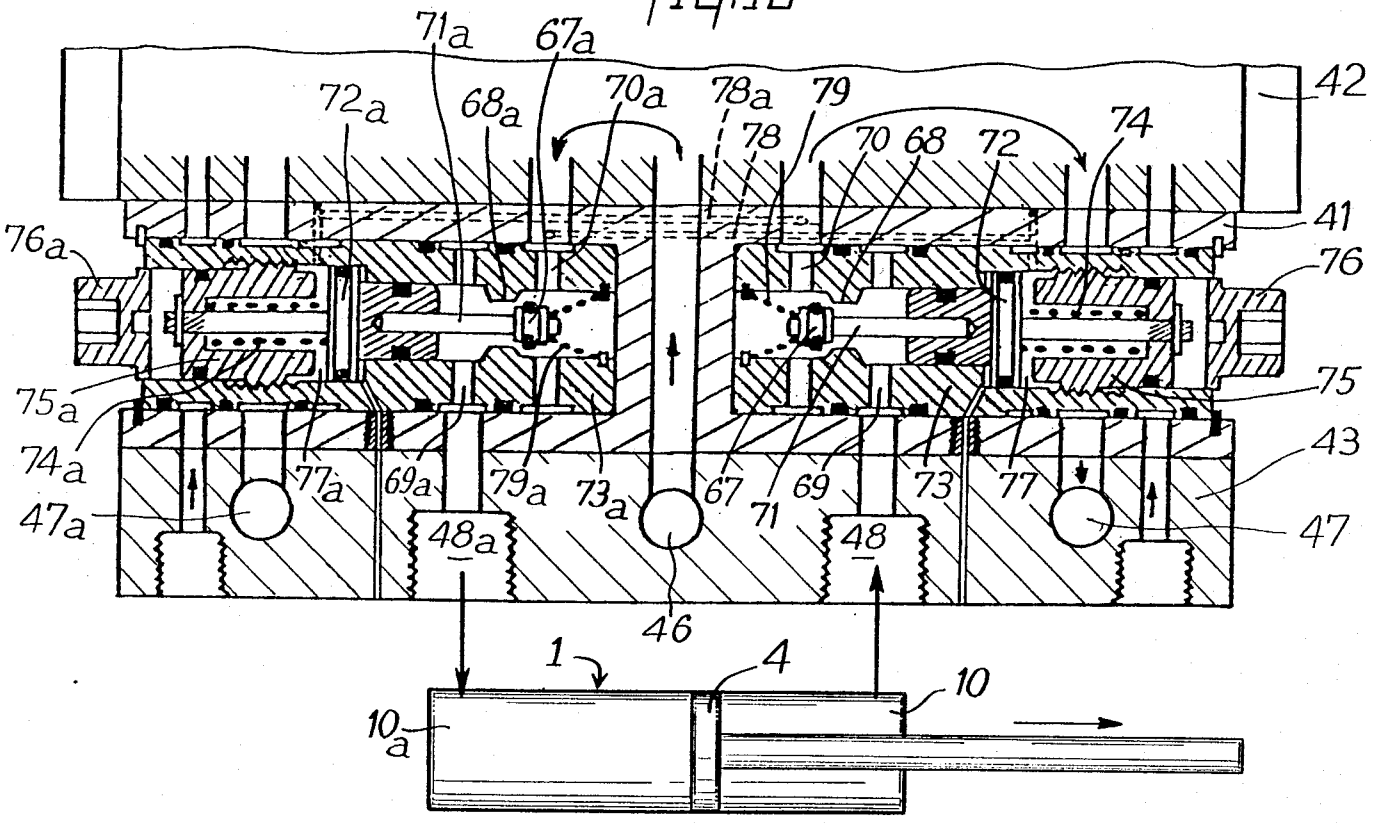
FIG. 10 is an axial section of another embodiment of a saving device controlled by pressure-drop.

FIG. 10 illustrates a variant embodiment of the compressed fluid saving double device, whose body 41 is mounted in the same way as in FIG. 8, between the distributor 42 and the base 43. In this variant, a valve member 67, 67*a* subjected to the action of a spring 79, 79*a* is held in open position with respect to the orifice 68, 68*a* connecting the pipes 69, 69*a* reaching up to chamber 10 and 10*a* of the jack and pipes 70, 70*a* selectively connected by distributor 42 with the compressed fluid circuit and the atmosphere.

Valve member 67, 67*a* comprises a rod 71, 71*a* which is mounted for sliding freely in a blind hole of the piston 72, 72*a* moving inside a cylinder provided in a liner 73, 73*a* mounted in tight manner in the body 41, said piston 72, 72*a* being subjected on its wider face to the action of a spring 74, 74*a* resting against a sleeve 75, 75*a* screwed into the liner 73, 73*a*, said liner being adapted to be actuated by a plug 76, 76*a* to adjust the pressure of the spring 74, 74*a*.

Moreover, chambers 77, 77*a* are connected to conduits 70, 70*a* via conduits 78, 78*a*.

When chamber 10*a* is fed with driving fluid via pipes 70*a* and 69*a*, the valve member 67*a* is in the open position, pushed back by piston 72*a* on which act the spring 74*a* and the pressure of the exhaust flow towards chamber 77*a*, against the action of the driving fluid acting on the smaller cross-section of the piston on the opposite face.

Once the pressure of the exhaust fluid disappears in chamber 77*a*, the spring 74*a* is compressed under the pressure of the driving fluid and piston 72*a* moves against the sleeve 75*a* thus permitting to the valve member 67*a* to close off the orifice 68*a* under the pressure of the driving fluid, and thus to cut off the flow of driving fluid between the pipes 70*a* and 69*a* towards the driving chamber 10*a*.

Furthermore, the exhaust fluid flowing from the chamber 10 traverses pipes 69 and 70, the valve member 67 being in open position and is directed towards the exhaust pipe 47 by way of the distributor 42.

Figure 11:
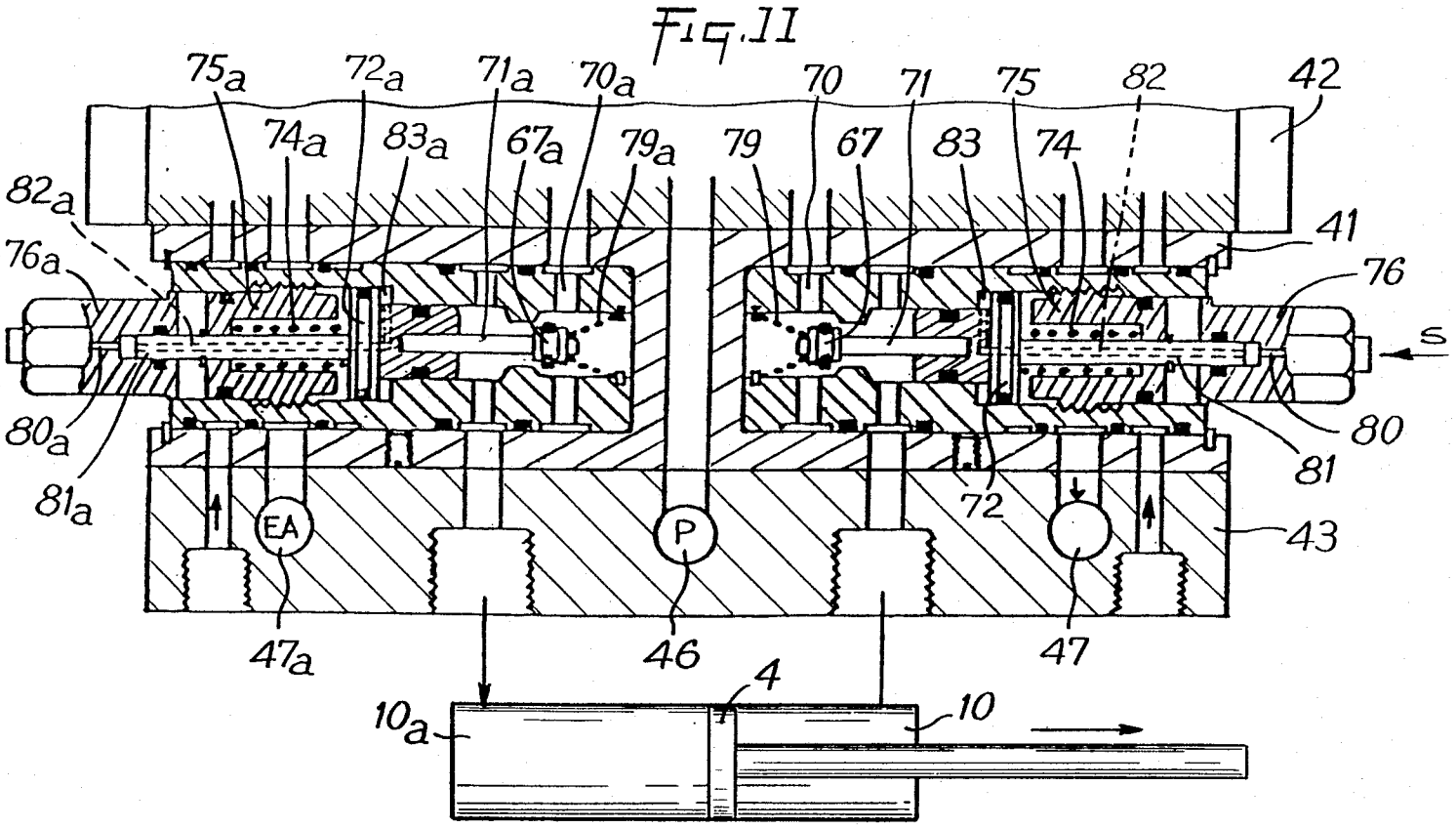
FIG. 11 is an axial section of another embodiment of the saving device controlled by a pneumatic signal.

FIG. 11 illustrates a saving device whose body 41 is mounted between the distributor 42 and a base 43 as illustrated in FIG. 8. The device is identical to that shown in FIG. 10, except that the plugs 76, 76*a* comprise conduits 80, 80*a* which are connected to sensors of the position of the piston 4, before the end or at the end of the stroke, which sensors deliver a pneumatic signal.

The piston 72, 72*a* is extended by a rod 81, 81*a* which extends through the sleeve 75, 75*a* and into the plug 76, 76*a*, said rod 81, 81*a* being provided with a conduit 82, 82*a* communicating on one side with conduit 80, 80*a* and on the other side with the chamber 83, 83*a* situated under the piston 72. When a pneumatic signal is issued at one end, and transmitted by conduits 80, 80*a* and 82, 82*a*, the piston 72, 72*a* is lifted against the action of the spring 74, 74*a* so that the valve member 67, 67*a* closes under the pressure of the driving fluid flowing from conduit 70, 70*a*.

Figure 13:
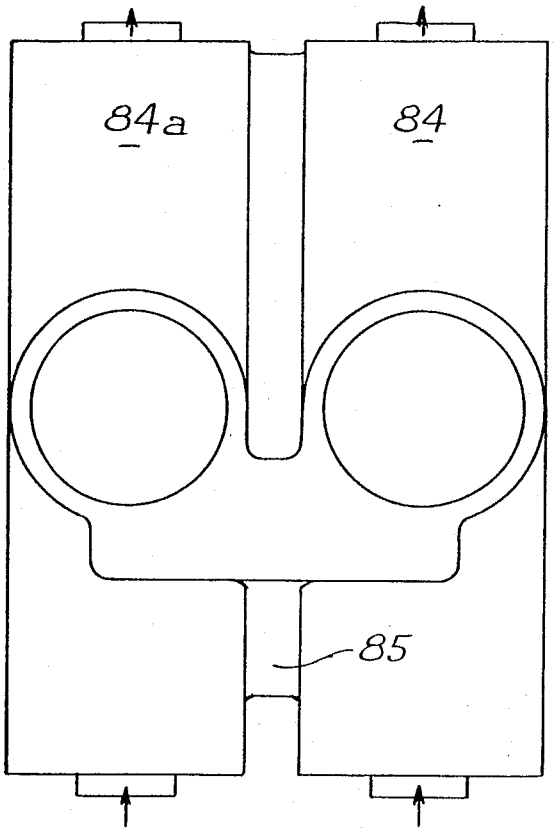
FIG. 13 is a plan view of FIG. 12.
Figure 12:
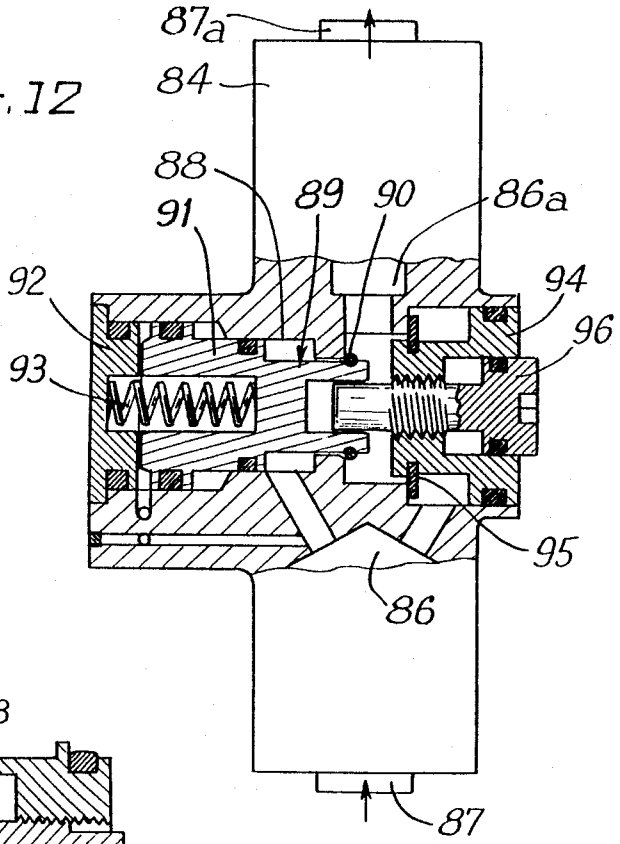
FIG. 12 is an axial section of a saving device fitted inside a dual-connector.

FIGS. 12 and 13 illustrate a saving device comprising a dual-connector body composed of two T-shaped members 84, 84*a*, joined together by a ribbing 85 and disposed so that their axes are parallel. Each member 84, 84*a* of the body (FIG. 12) is provided at its two ends with fluid passageways 86, 86*a* provided with means 87, 87*a* connecting them with outside pipes, each of said body members being provided in its center with a bore 88 perpendicular to passageways 86, 86*a* and in which is mounted a valve 89 equipped with a closing member 90 integral with a piston 91 mounted for sliding in a cylinder provided on one side of the bore 88 and closed by a plug 92 against which rests one end of a spring 93, whose other end acts in combination with the exhaust pressure on the piston 91. The other end of the bore is closed by a plug 94 equipped with a deformable membrane 95 forming non-return valve and a screw 96 engaged in a tapped hole of the plug 94, said screw 96 limiting the stroke of the valve 89 and permitting to adjust the speed of the piston of the jack. This device works identically to that illustrated in FIG. 10 and described hereinabove.

Figure 14:
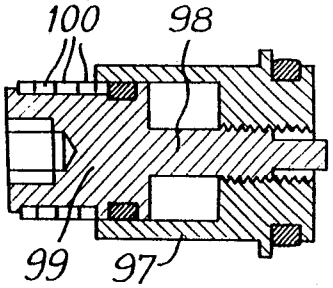
FIG. 14 is an axial section of a pressure regulating sleeve for the dual-connector device.

According to a variant of embodiment (FIG. 14) it is possible to replace the plug 92 by an obturating sleeve 97 mounted in the bore 88 and presenting a tapped hole in which is screwed the threaded part of a stem 98 for adjusting the tension of the spring 93 which spring acts on the piston 91 in order to vary the output pressure. Said stem 98 is extended by a control head 99 equipped with colored rings 100 displaying the saving obtained.

Figure 16:
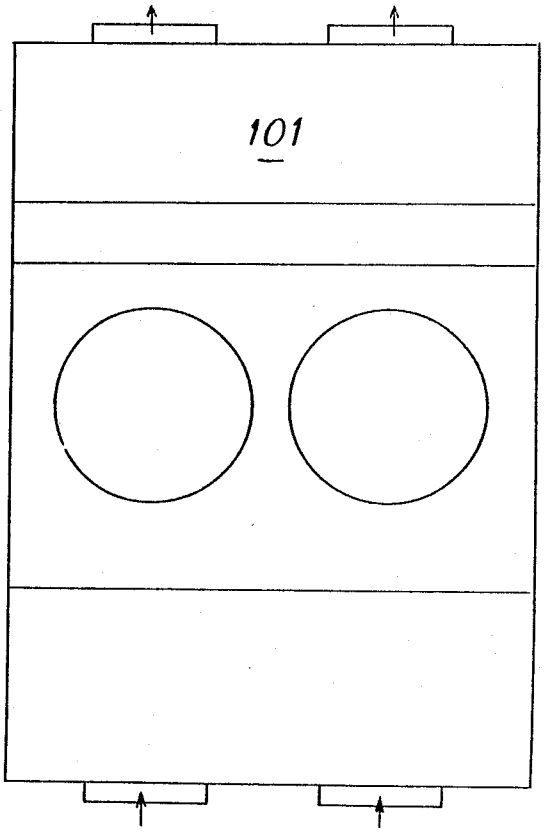
FIG. 16 is a plan view of the connector shown in FIG. 15.
Figure 15:
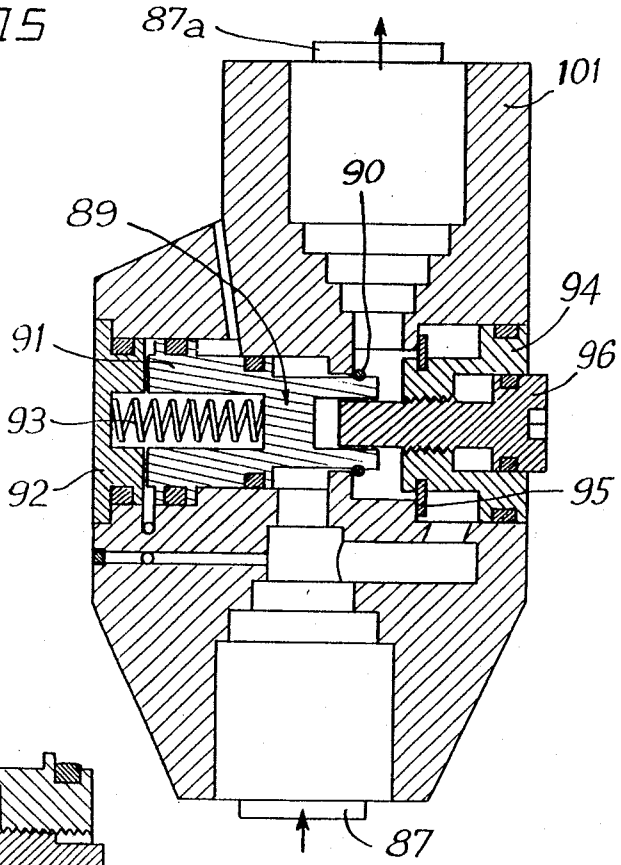
FIG. 15 is an axial section of another embodiment of the saving device mounted in a dual connector.
Figure 17:
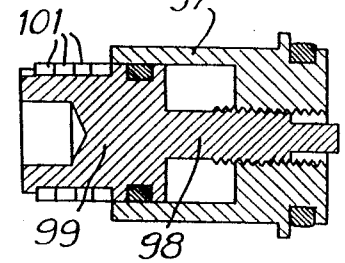
FIG. 17 is an axial section of a pressure-regulating sleeve.

FIGS. 15 and 16 show a variant embodiment of a saving device comprising a dual-connector body 101 forming a compact unit and containing two identical saving assemblies identical to that shown in FIG. 12 and described hereinabove. Likewise FIG. 17 illustrates a regulating sleeve 97 which can replace the plug 92 to adjust the spring 93 and the fluid exhaust pressure.

FIGS. 18 and 19 illustrate a saving device comprising a dual-connector body composed of two T-shaped elements 84, 84*a* joined together by a ribbing 85 and disposed so that their axes are parallel.

Each element 84, 84*a* of the body (FIG. 18) is provided at its ends with fluid passageways 86, 86*a* which are provided with means connecting them with outside pipes, each element being provided in its center with a bore 102 perpendicular to the passageways 86, 86*a*. On one side of the bore 102 is mounted a plug 103 against which rests a spring 104 pushing back a valve member 105 controlling the flow of driving fluid and exhaust fluid, said valve member 105 being extended by a rod 106 which is mounted for sliding inside a blind hole of a piston 107 sliding in the bore 102, said piston being subjected on one face to the action of a spring 108 resting against a control plug 109 screwed into the central bore and to the pressure of the exhaust fluid.

This particular device works identically to that shown in FIG. 10 and described herein.

FIG. 20 illustrates a saving device comprising a single connector 110 containing a valve 111 controlling the passage of the fluid and presenting an orifice 112 connected via a conduit 113 to a chamber 10 of a jack 1 and a conduit 114 connected to a distributor 115 adapted to place said chamber 10 in communication with a source of fluid under pressure and with the atmosphere.

The other chamber 10*a* of the jack is connected via a conduit 116 directly with the distributor 115, but obviously it would also be possible to fit on conduit 116 another single connector identical to connector 110 equipped with a saving device. Said connector 110 comprises a main body 117 provided at its base with a threaded portion 130 enabling it to be fitted in a tapped hole of a support or connection member, or of the distributor 115, said body 117 containing a valve 111 controlling the flow of fluid, said valve being controlled by a piston 118 actuated by a pneumatic signal or by a certain quantity of fluid directed into a chamber 119 provided in the upper part of the piston and a plug 120 screwed into a tapped portion of the body 117, said plug being perforated through to form a conduit 121 connected via a conduit 122 with a sensor 123 of the position of the piston 4 of the jack.

In conduit 114 is provided a movable seat 124 which is pushed against a shoulder of the body and against the obturating member of the valve, by a spring 125.

The main body 117 receives a bushing 126 which comprises a pipe 127 by which the conduit 113 communicates with the conduit 114 via the space between the valve 11 and the main body, and via orifice 128 and conduit ti 112 of pipe 127. When piston 4 moves in the direction of arrow 129, the valve 11 is in open position due to the fact that the chamber 119 contains no fluid and that it is in high position, the distributor feeds the conduit 114 and chamber 10 with driving fluid, whereas chamber 10*a* is connected via conduit 116 and the distributor 115 with the exhaust into the atmosphere.

When the piston 4 reaches end-of-stroke or before it does, said piston acts on the sensor 123 which sends a pneumatic signal to chamber 119 pushing the piston 118 downwards and the valve 111 against the seat 124 thus closing off the passageway into chamber 10 and interrupting the driving fluid supply to said chamber.

When chamber 10 is in exhaust phase, the seat 124 forming valve member is pushed back against the action of the spring 125, thus allowing the exhaust towards the atmosphere via the distributor 115.

The invention is in no way limited to the description given hereinabove and on the contrary covers any modifications that can be brought thereto without departing from the scope or the spirit thereof.

What we claim is:

1. Compressed fluid saving device permitting regulation of the pressure of driving fluid produced by a pressurized-fluid supply system in a pressurized-fluid-using apparatus, such as a jack having a chamber and a movable jack member mounted in the chamber for movement and dividing the chamber into a pair of secondary chambers adapted to be selectively pressurized with driving fluid for moving said movable jack member through two strokes, said regulation being to a pressure below that produced by the supply system, the device comprising:

valve members movable in response to the pressure in the secondary chambers for selectively supplying driving fluid under pressure to the secondary chambers to move the movable jack member in one or the other stroke thereof; and movable seat members for cooperating with said valve members to permit full flow of fluid out of the secondary chamber not selected for supply with driving fluid under pressure during both strokes of the movable jack member and to stop the flow of driving fluid under pressure to the secondary chamber selected for supply with driving fluid under pressure before the end or at the end of both strokes of the movable jack member.

2. Saving device as claimed in claim 1, wherein said valve members are selectively opened and kept open by the pressure of the fluid in the secondary chamber in the exhaust phase and closed up, when said pressure disappears, by an elastic member.

3. Saving device as claimed in claim 1, wherein said valve members are selectively opened and kept open by the pressure in the secondary chamber in the exhaust phase and closed up, when said pressure disappears, by the pressure of the driving fluid.

4. Saving device as claimed in claim 1, wherein said device comprises means for controlling the position of said valve members so as to control the flow of fluid under pressure and the speed of the movable jack member.

5. Saving device as claimed in claim 1, wherein each said valve member is associated with a secondary chamber and wherein each said seat member is associated with one of said valve members and is adapted to occupy selectively a closing position relative to a respective associated valve member under the pressure of the driving fluid and each said valve member is adapted to occupy selectively an open position under the pressure of fluid from the respective unassociated secondary chamber.

6. Saving device as claimed in claim 1, wherein said valve members open under the pressure of the driving fluid and wherein said device further comprises a position sensor for providing a pneumatic signal, said valve members closing by the pressure of the driving fluid provided in response to the pneumatic signal provided by the position sensor corresponding to a position of the movable jack member, before the end or at end of a stroke thereof.

7. Saving device as claimed in claim 5, wherein the position sensor senses the movement of the movable jack member.

8. Saving device as claimed in claim 5, wherein the position sensor senses the end of the stroke of the movable jack member.

9. Saving device as claimed in claim 6, wherein position sensor comprises a pressure-drop sensor for delivering a pneumatic signal when a drop of pressure occurs in the jack on the exhaust side thereof.

10. Saving device as claimed in claim 6, wherein the pneumatic signal is issued from a circuit associated to the movement of another jack which initiates said pneumatic signal immediately when the first controlled jack reaches the end of a stroke thereof.

11. Saving device as claimed in claim 6, wherein said device comprises a body having a pneumatic control circuit integrated to said body for providing the pneumatic signal.

12. Saving device as claimed in claim 1, wherein said device comprises a body in which is mounted said valve members, each said valve member controlling an orifice in an associated said seat member forming a passageway between respective secondary chambers and a fluid distributor.

13. Saving device as claimed in claim 12, wherein each valve member has a closing member for cooperating with said orifice in said associated seat member, said valve and seat members being mounted for sliding inside cylinders in the body, and wherein said valve member includes a piston subjected on its two faces to the action of an elastic member and of fluid under pressure.

14. Saving device claimed in claim 12, wherein each valve member has a closing member for cooperating with said orifice in said associated seat member, said valve and seat members being mounted for sliding inside cylinders in the body, and wherein said valve member includes a piston subjected on its two faces to the action of fluid under pressure.

15. Saving device as claimed in claim 1, wherein a body contains said valve members and is mounted between a distributor and a base member with said body contacts by two of its faces, said base member having integrated channels and making the communication, on the one hand, with pipes issuing on one of the faces of said body and, on the other hand, with the jack and fluid admission and exhaust pipes, said body being provided on another face thereof with pipe orifices situated opposite orifices of pipes of the distributor.

16. Saving device as claimed in claim 15, wherein said device further comprises two valve members of the open type for controlling the flows of driving fluid and exhaust fluid, each valve member being subjected to the action of a spring and including a rod having an end mounted for sliding inside a blind hole of a piston subjected on one of its faces having a larger cross-section to the combined action of a spring and exhaust pressure and on another face of smaller cross-section to the pressure of the driving fluid.

17. Saving device as claimed in claim 15, wherein said device further comprises two valve members of the open type for controlling the flows of driving fluid and exhaust fluid, each valve member being subjected to the action of a spring and including a rod having an end mounted for sliding inside a blind hole of a piston subjected on one of its faces having a larger cross-section to the combined action of a spring and exhaust pressure and on the another face of smaller cross-section to the action of a pneumatic signal issued by a sensor of the position of the movable jack member and to the pressure of the driving fluid.

18. Saving device as claimed in claim 15, said device further comprising two non-return valves for controlling the flow of exhaust fluid from the secondary chambers.

19. Saving device as claimed in claim 18, wherein the valves members are of the open type and comprise obdurating members mounted for sliding inside the body and are integral with pistons subjected on one face to the combined action of a spring and the pressure of exhaust fluid and on the other face to the action of the pressure of the driving fluid, said spring having just enough strength to keep the valve members open when there is no pressure on the other face of the piston.

20. Saving device as claimed in claim 18, wherein the valve members are of the open type and comprise obdurating members integral with pistons subjected on one face to the action of a spring for opening the respective valve member and on the other face to the action of a pneumatic signal for closing the valve, said signal being issued by a sensor of the position of the movable jack member.

21. Saving device as claimed in claim 1, wherein said device comprises a dual-connector body containing two saving assemblies disposed in parallel, each comprising at its two ends fluid passageways provided with means for connecting them with outside pipes, said body being provided in its center with two bores perpendicular to the passageways in which are mounted non-return valves controlling the flow of exhaust fluid.

22. Saving device as claimed in claim 21, wherein the body comprises two T-shaped members joined together by ribbing.

23. Saving device as claimed in claim 21, wherein on one side of each bore there is provided a plug against which rests a spring for pushing back a valve member controlling the flow of driving fluid and of exhaust fluid, said valve member being extended by a rod mounted for sliding in a blind hole of a piston sliding inside the bore, said piston being subjected on one of its faces to the action of a spring resting against a plug screwed into the central bore on the other side of the valve member and to the pressure of exhaust fluid.

24. Saving device as claimed in claim 21, wherein each valve member comprises an obdurating member integral with a piston mounted for sliding inside a cylinder provided on one of side of a bore and closed by a plug against which rests one of the ends of a spring, the other end of which acts in combination with the exhaust pressure against the piston of the valve, the other end of the bore being closed off by a plug equipped with a deformable diaphragm forming a non-return valve and a screw limiting the stroke of the valve and permitting adjustment of the speed of the movable jack member.

25. Saving device as claimed in claim 24, further comprising means for adjusting the tension of the spring, which means are provided with colored rings for the visual display of the fluid saving.

26. Saving device as claimed in claim 1, wherein said device further comprises a connector containing a valve member for controlling the flow of fluid and including an orifice in communication with a secondary chamber of the jack and another orifice for connection to a distributor adapted to connect the secondary chamber with a source of driving fluid and with the atmosphere.

27. Saving device as claimed in claim 26, wherein the connector comprises a main body provided at its base with a threaded portion adapted to be fitted in a tapped hole of a support member, said main body containing a valve member for controlling the flow of fluid and actuated by a piston subjected to the action of a pneumatic signal, said body receiving a bushing provided with a pipe for connecting a secondary chamber with the orifice through which fluid flows into the body.

* * * * *

UNITED STATES PATENT AND TRADEMARK OFFICE

CERTIFICATE OF CORRECTION

PATENT NO. : 4,608,910

DATED : September 2, 1986

INVENTOR(S) : Yves Levenez et al.

It is certified that error appears in the above-identified patent and that said Letters Patent is hereby corrected as shown below:

Column 4, line 12, change "parts" to -- part --.

Column 5, line 23, change "45" to -- 46 --.

Column 5, line 24, change "46" to --45--.

Column 6, line 7, change "plugs" to --plug--.

Column 8, line 25, delete "ti".

Column 9, line 39 (Claim 7, line 1), change "5" to --6--;
line 42 (Claim 8, line 1), change "5" to --6--.

Column 10, line 12, change "with" to --which--.

Signed and Sealed this

Third Day of February, 1987

*Attest:*

*Attesting Officer*

DONALD J. QUIGG

*Commissioner of Patents and Trademarks*